United States Patent [19]

Kasahara et al.

[11] Patent Number: 4,872,037

[45] Date of Patent: Oct. 3, 1989

[54] IMAGE FORMING APPARATUS AND CONTROL SYSTEM THEREFOR

[75] Inventors: Nobuo Kasahara; Tosio Nakahara; Masayosi Watanuki, all of Yokohama; Tadahide Sawamura, Tokyo, all of Japan

[73] Assignee: Ricoh Company, Ltd., Tokyo, Japan

[21] Appl. No.: 163,026

[22] Filed: Mar. 2, 1988

Related U.S. Application Data

[63] Continuation-in-part of Ser. No. 12,492, Feb. 9, 1987, Pat. No. 4,733,269.

[30] Foreign Application Priority Data

Mar. 2, 1987 [JP] Japan ..... 62-46995

[51] Int. Cl.[4] ..... G03G 15/16; G03G 15/00

[52] U.S. Cl. ..... 355/271; 355/204; 430/199

[58] Field of Search ..... 355/4, 14 TR, 3 TR, 355/3 R, 3 SH, 14 SH, 271, 204; 118/645; 430/54, 199, 357

[56] References Cited

U.S. PATENT DOCUMENTS 4,705,386 11/1987 Ogita et al. ..... 355/14 TR X 4,723,145 2/1988 Takada et al. ..... 355/3 TR 4,788,572 11/1988 Slayton et al. ..... 355/3 TR

*Primary Examiner*—A. C. Prescott

*Attorney, Agent, or Firm*—Oblon, Spivak, McClelland, Maier & Neustadt

[57] ABSTRACT

A control system for a color copier which sets up an adequate color copying time for any particular size of paper sheets. A color document is repeatedly scanned to sequentially expose a single photoconductive drum, which is rotated at a constant speed, to a plurality of separated color components. Each of the latent images is developed by toner complementary in color to the color component associated with the latent image, and sequentially transferred to a paper sheet. The control system includes a paper size setting circuit, a scanning sensor for sensing the start of a scanning, and a home sensor for sensing an instantaneous angular position of the transfer drum. A control circuit is constructed to determine a transfer start and a transfer end time in response to a paper size signal, an output signal of the scanning sensor, and an output signal of the home sensor, and to variably control the rotation speed of the transfer drum during the interval between the transfer start and transfer end times so as to register the leading end of a paper sheet loaded on the transfer drum and that of each of the toner images.

22 Claims, 14 Drawing Sheets

| |
|---|
| Fig. 5 A |
| Fig. 5 B |

IMAGE FORMING APPARATUS AND CONTROL SYSTEM THEREFOR

CROSS REFERENCE TO RELATED APPLICATION

This application is a continuation-in-part of copending U.S. patent application Ser. No. 012,492, filed Feb. 9, 1987 now U.S. Pat. No. 4,733,269.

BACKGROUND OF THE INVENTION

The present invention relates to an image forming apparatus of the type having photoconductive means and transfer means which are each implemented with a drum and are driven independently of each other to be indiviually rotatable at variable speeds, and accelerating the rotation of the transfer drum relative to that of the photoconductive drum during the interval between consecutive image transfers in matching relation to a size of paper sheets so as to increase the copying speed, and a control system for such an apparatus. More particularly, the present invention is concerned with a color copier or like color image forming apparatus capable of reducing a period of time necessary for copying, or copying time, and a control system for such an apparatus.

In a prior art color copier, it has been customary to adopt an arrangement wherein a color original document is repetitively scanned by optics which includes a plurality of color separating filters while, at the same time, exposures by a plurality of separated color components are sequentially effected. The resulting latent images formed on a photoconductive drum, or photoconductive means, are individually developed by toner of complementary colors which are supplied by a developing device, and the resulting toner images are sequentially transferred to a paper sheet which is clamped on the transfer drum, or transfer means, which is in turn held in contact with the photoconductive drum. The photoconductive drum and the transfer drum are interconnected by gears or the like which involves little backlash so as to be driven together and each at a constant speed. The optics are driven by, for example, a servo motor which rapidly responds to speed control. A problem with this kind of driving system is that an extra gear train and other elements needed to operatively connect the photoconductive and transfer drums to each other increase the overall size of the apparatus. Another problem is that mechanical vibrations ascribable to the gears and other are apt to bring about jitter, failure of register, damage to images and other undesirable occurrences. In addition, such a number of structural elements have be to individually machined with substantial accuracy and result in difficult maintenance as well as in poor durability and reliability.

On the other hand, a prerequisite with a prior art color copier of the type described is that respective color components reproduced by consecutive transfers be accurately registered to provide a copy of high quality. This prerequisite cannot be satisfied unless the circumferential length of one of the photoconductive and transfer drum is an integral multiple of that of the other, as generally accepted. Specifically, assuming that the photoconductive drum has a circumferential length of P while the transfer drum has a circumferential length of T, they have to be designed such that an equation $T=n \cdot P$ ($n=1, 2, 3 \ldots$) holds when T is greater than P and an equation $P=n \cdot T$ holds ($n=1, 2, 3 \ldots$) when T is smaller than P. Otherwise the above-described kind of drum driving system which relies on gears or the like fails to drive the optics, photoconductive drum and transfer drum in synchronism and, especially, it prevents the consecutive color-by-color transfers in a color combining mode from being started at the same positions. For this reason, despite that the circumferential length of the transfer drum need only be slightly greater than the longitudinal dimension of format A4 of general purpose PPC paper sheets which are extensively used today, it has heretofore been dimensioned far greater than the same.

In the above-described driving system, the rotation of the transfer drum, for example, follows that of the photoconductive drum so that the copying time remains the same with no regard to the format of paper sheets. Therefore, it is impossible for the transfer drum to be accelerated relative to the photoconductive drum after the trailing edge of a paper sheet of comparatively small format has moved past a transfer position, for the purpose of speeding up the copying operation. A control system capable of setting up an adequate copying time which matches itself to a paper size is disclosed in Japanese Laid-Open Publication (Kokai) No. 60-218673. The system disclosed uses a scanning sensor responsive to a scan start position of the optics, and a paper sensor disposed near the transfer drum to sense the trailing edge of a paper sheet loaded on the drum. The times at which a transfer is started and ended are determined on the basis of the ouput signal of the scanning sensor and that of the paper sensor, respectively. During the interval between the times of the start and end of transfer determined so, the rotation speed of the transfer drum is variably controlled to register the leading edge of the paper sheet and that of each toner image representative of a particular color component.

Such a system, however, cannot be accomplished without increasing the cost because the paper sensor responsive to the trailing edge of a paper sheet has to be associated with the transfer drum. Further, the accuracy of detection attainable with the paper sensor is limited and, therefore, the entire system lacks reliability.

SUMMARY OF THE INVENTION

It is, therefore, an object of the present invention to provide a color copier or like color image forming apparatus which is simple in construction and, yet, capable of controlling the operation of the copier based on information for setting up an adequate copying time associated with a paper size, and a control system for such an apparatus.

It is another object of the present invention to provide a color copier or like color image forming apparatus which allows the circumferential length of one of photoconductive and transfer drums to be not an integral multiple of that of the other for thereby promoting miniaturization apparatus, quality reproduction, and others, and a control system therefor.

It is another object of the present invention to provide a generally improved image forming apparatus and a control system therefor.

In accordance with the present invention, a control system for a color copier having optics for scanning, a photoconductive means, and transfer means comprises a paper size setting circuit for setting a size of a paper sheet to be used before a copying operation, a scanning sensor for sensing the start of a scanning performed by the optics, a home sensor for sensing an instantaneous angular position of the transfer means, and a control for determining a transfer start time and a transfer end time in response to a paper size signal outputted by the paper size setting circuit, an output signal of the scanning sensor, and an output of the home sensor, and variably controlling a rotation speed of the transfer means during an interval between the transfer start and transfer end times so as to register a leading edge of a paper sheet loaded on the transfer means and a leading edge of each of toner images formed on the photoconductive means and a different in color from each other.

Also, in accordance with the present invention, a control system for a color copier having optics for scanning, photoconductive means, and transfer means comprises a paper size setting circuit for setting a size of paper sheet to be used before a start of a copying operation to produce a paper size set signal, a scanning sensor for sensing the start of a scanning performed by the optics to produce a scanning start signal, a home sensor for sensing a home position of the transfer means to produce a home position signal, drive circuitry for driving the optics, photoconductive means and transfer means independently of each other, a control for realizing different timing programs which are selectable, the respective timing program for timing the complete copying operation sequence being changeable in dependence upon the paper size set signal of the paper size setting circuit, scanning start signal of the scanning sensor, and home position signal of the home sensor, and servo circuitry for adjusting predetermined operation parameters of the color copier so as to selectively adjust the respective drive circuitry in response to the respective timing program.

Further, in accordance with the present invention, an image forming apparatus comprises, in combination, movable photoconductive means and transfer means one of which is greater in circumferential length than the other by a multiple other than integral multiples, and drive control circuitry for independently controlling the photoconductive means and transfer means.

DESCRIPTION OF THE PREFERRED EMBODIMENTS

To better understand the present invention, a brief reference will be made to a prior art color copier, particularly the control system disclosed in Japanese Laid-Open Publication (Kokai) No. 60-218673.

Figure 1:
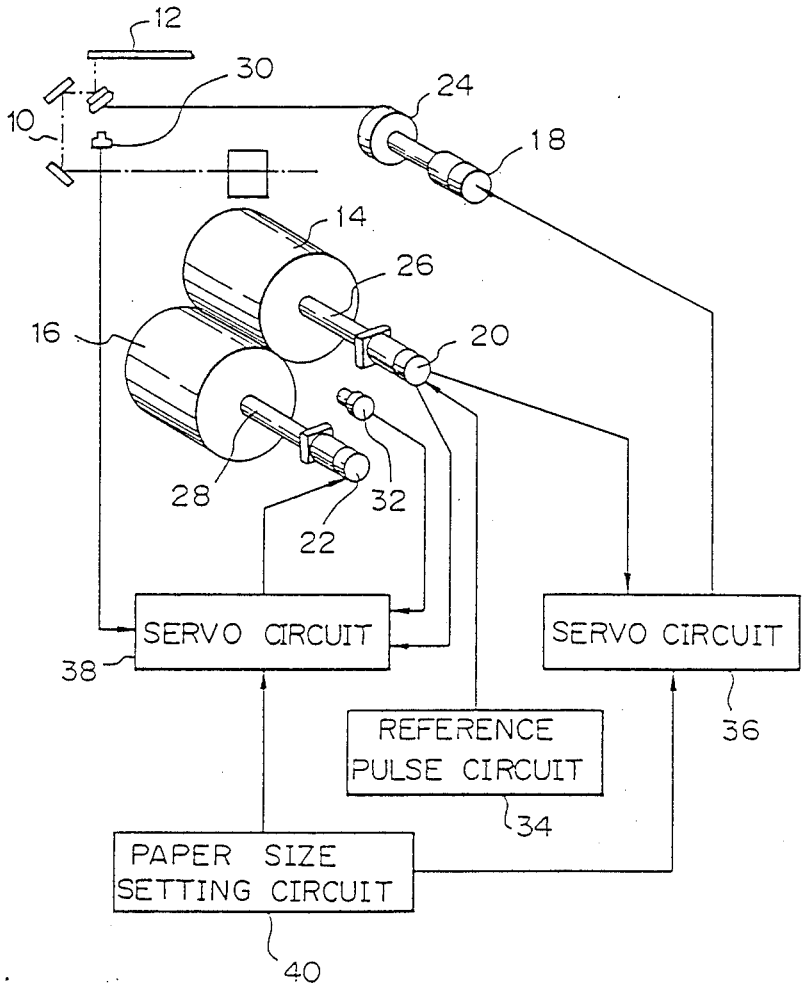
Fig. 1 PRIOR ART
FIG. 1 is a schematic view showing an exemplary control system which is installed in a prior art color copier.

As shown in FIG. 1, the prior art system basically includes scanning optics 10 for repetitively scanning a color original document 12, and a single photoconductive drum 14 which is rotated at a constant speed and sequentially exposed to a plurality of color components repesentative of the document 12. Every time a latent image is electrostatically formed on the drum 14 by the above procedure, it is developed by toner of a complementary color to that associated with the latent image. The resulting toner images are sequentially transferred to a paper sheet which is held by a transfer drum 16, which is rotated in contact with the photoconductive drum 14. A servo motor 18 is drivably connected to the optics 10 by a capstan shaft 24. Likewise, servo motors 20 and 22 are drivably connected to the drums 14 and 16 by rotary shafts 26 and 28, respectively. The servo motor 18 is reversible because the optics 10 has to be moved in a reciprocating motion.

A scanning sensor 30 is provided for sensing the position (home position) of a lamp and others within a scanning mechanism before the start of a scanning stroke, i.e., a scan start position of the optics 10. Also provided is a paper sensor 32 which is located in the vicinity of the transfer drum 16 to sense the trailing edge of the paper sheet loaded on teh drum 16. A control system of the color copier includes a reference pulse circuit 34 for generating reference pulses which cause the servo motor 20 associated with the photoconductive drum 14 to be rotated at a constant speed, servo circuit 36 and 38 for controllably driving the other servo motors 18 and 22 in relation to the servo motor 20, and a paper size setting circuit 40 for delivering a paper size command to the servo circuits 36 and 38.

With the above construction, the system determines the times when a transfer has started and ended in response to the output signals of the sensors 30 and 32. During the interval between those times determined, the rotation speed of the transfer drum 16 is variably controlled so as to register the leading end of the paper sheet on the drum 16 and that of each toner image on the drum 14. Specifically, it is not that the scanning and exposure is started at the same time for all the images of different colors by awaiting the completion of one full rotation of the drum 14, but that as soon as the scan-back (return) of the optics 10 is completed the next scanning begins to expose the drum 14 imagewise. Hence, the scanning stroke becomes as short as the size of paper sheets. The rotation speed of the drum 16 is controlled independently of the drum 14 in order to eliminate the deviation of images transferred.

However, as previously stated, such a prior art system cannot be accomplished without increasing the cost because the paper sensor responsive to the trailing edge of a paper sheet has to be associated with the transfer drum. Further, the accuracy of detection attainable with the paper sensor is limited and, therefore, the entire system lacks reliability.

FIRST EMBODIMENT

A first embodiment of the color copier embodying the present invention and which is free from the drawbacks discussed above will be described with reference to FIGS. 2 to 6.

Figure 2:
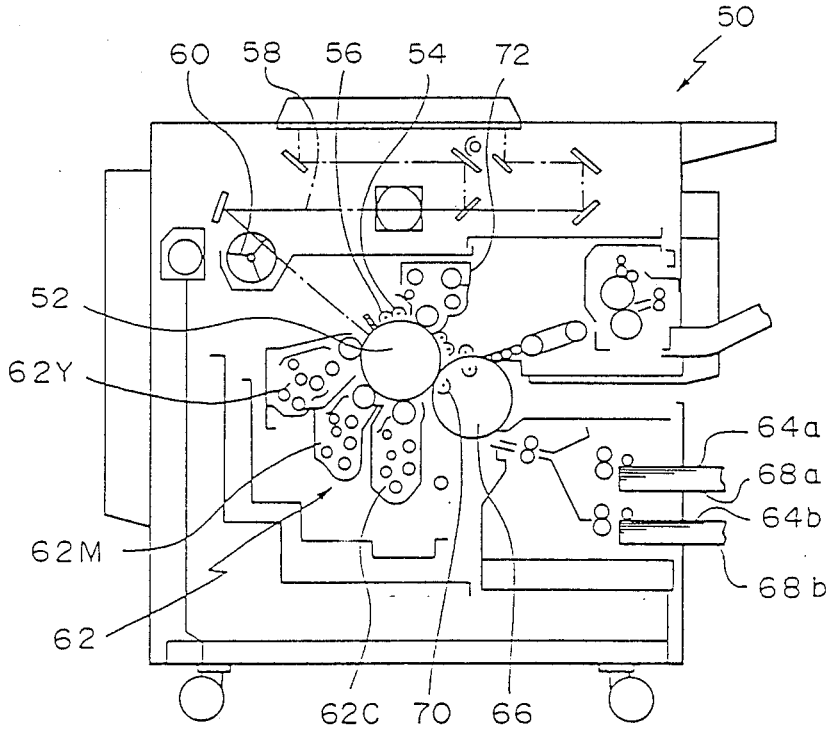
FIG. 2 is a sectional side elevation of a color copier embodying the present invention.

Referring to FIG. 2, the color copier, generally 50, includes a photoconductive drum 52 which is located in a central part inside a housing of the copier, A charger 54 and an erase 56 are arranged around the drum 52. Scanning optics 58 is disposed above the drum 52. The optics 58 is constructed as well known in the art and, as shown in FIG. 2, made up of a lamp, mirrors, a lens and others. The optics 58 repetitively performs a scanning stroke from a home position as indicated by solid lines to a position (a length corresponding to that of a document) as indicated by phantom lines, and a return stroke from the latter to the former in the opposite direction. A color filter 60 adapted for the separation of colors is disposed in the optical path of the optics 58. A developing device 62 is located next to a position where an image is formed by the optics 58. As shown, the developing device 62 consists of a magenta developing unit 62M, a cyan developing unit 62C and a yellow developing unit 62Y which are adapted for color copying. Located next to the device 62 is a hollow transfer drum 66 which is rotatable with any of paper sheets 64*a* and 64*b* loaded thereon. Specifically, any of the paper sheets 64*a* and 64*b* which are different in size and fed from cassettes 68*a* and 68*b*, respectively, is clamped by the drum 66 to undergo a plurality of consecutive times of transfer. A transfer charger 70 is disposed in the hollow drum 66. The reference numeral 72 designates a cleaning device.

Basically, the operation of the color copier 50 comprises the steps of: causing the optics 58 to repetitively scan a color original document to sequentially expose the photoconductive drum 52, which is rotated at a constant speed, to a plurality of different color components which are representative of the document, developing each of the resulting latent images on the drum 52 by supplying from the developing device 62 toner whose color is complementary to that of the color component and sequentially transferring the toner images onto the paper sheet 68*a* or 68*b* which is held by the drum 66.

Figure 3:
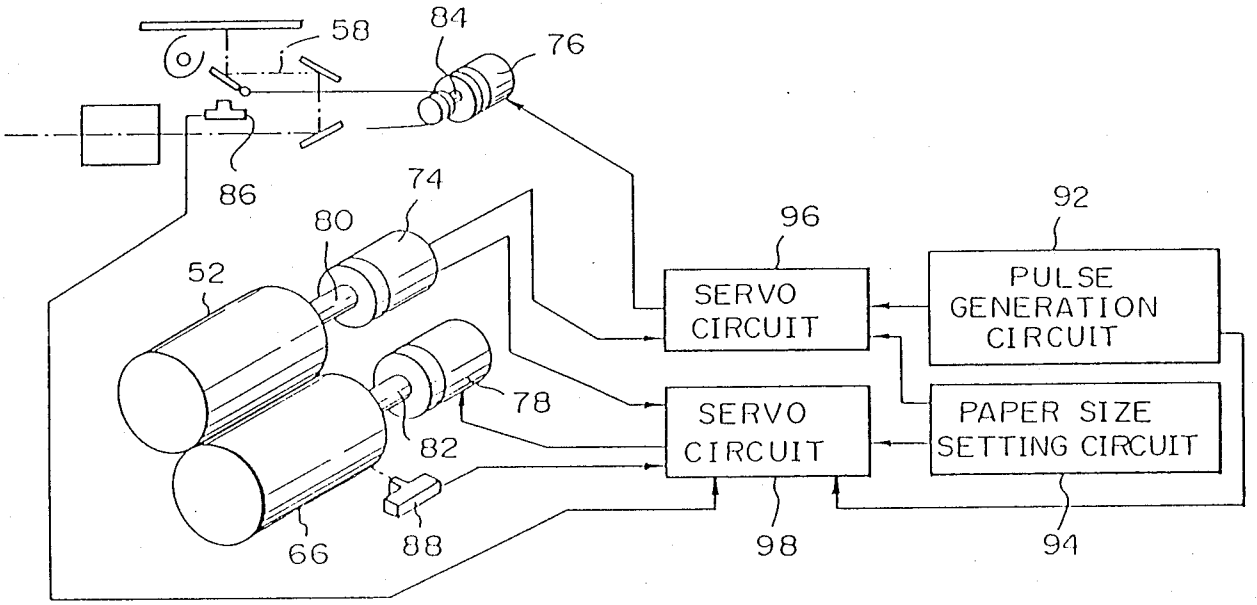
FIGS. 3 and 4 are block diagrams schematically showing a control system which is associated with the copier of FIG. 2.
Figure 4:
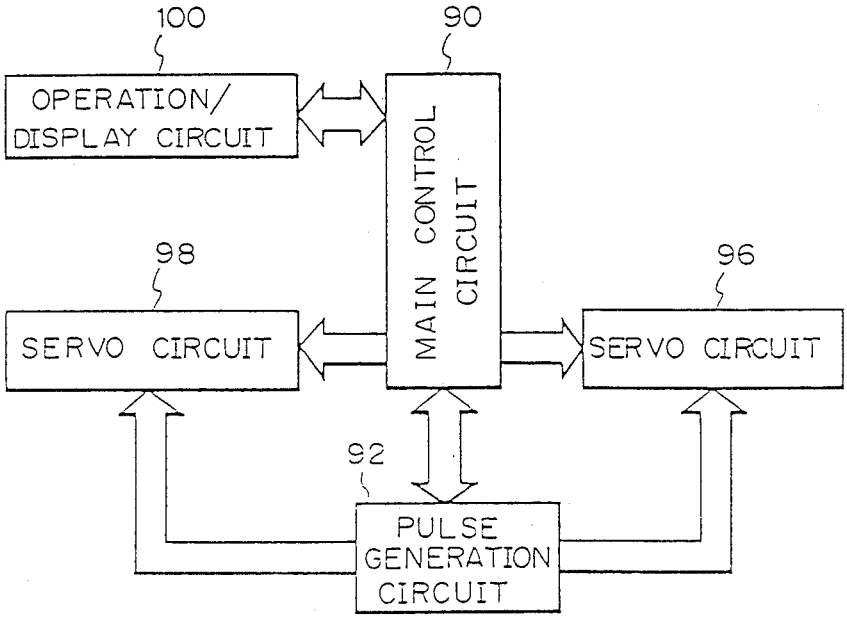

Referring to FIGS. 3 and 4, a driven system and a control system for the photoconductive drum 52, optics 58 and transfer drum 66 are shown. Servo motors 74, 76 and 78 are drivably connected to the drum 52, optics 58 and drum 66 by a rotary shaft 80, a capstan shaft 84, and a rotary shaft 82, respectively. As in the prior art system, a scanning sensor 86 is provided for sensing the time at which the optical system starts a scanning stroke (i.e. home positions). The transfer drum 66 is provided with a home sensor 88 which is adapted to sense the home position of the drum 66 for controlling the motions of the drum 66, e.g. paper clamp timing.

Further, as shown in FIG. 4, a main control circuit 90 is provided to control all the loads except for the transfer drum 66 and optics 58. The operation timings of each of the loads are controlled on the basis of reference pulses. A pulse generation circuit 92 generates pulses necessary for controllably driving the servo motors 76 and 78 in response to the reference pulses which are generated inside of the main control circuit 90. A paper size setting circuit 94 is connected to servo circuit 96 and 98, which are respective associated with the servo motors 76 and 78, in order to deliver a command which is representative of the size of the paper sheets 64*a* or 64*b* used. In the block diagram of FIG. 4, the paper size setting circuit 94 constitutes a part of an operation and display circuit 100 and is therefore connected to the main control circuit 90.

As shown and described, what clearly distinguishes this embodiment from the prior art system is that the transfer drum 66 is not provided with an extra sensor, i.e., a paper sensor and, instead, controlled on the basis of the output of the existing home sensor 88 which is associated with the transfer drum 66. Specifically, all the loads except for the transfer drum 66 and optics 58 and controlled by the main control circuit 90 based on the reference pulses, as previously stated. While the optics 58 is controlled by the servo circuit 96, the main control circuit 90 can grasp the periods of time, i.e. timings associated with the scanning speed and the returning speed of the optics 58 if the size of a document to be duplicated is known beforehand. The size of a document can be determined based on that of paper sheets 64*a* or 64*b* which is indicated by the paper size setting circuit 94. Specifically, in a 1 magnification condition, the document size is identical with the paper size while, in another magnification condition, the document size is (paper size)/(magnification). Likewise, while the transfer drum 66 is controlled by the servo circuit 98, the main control section 90 can determine an instantaneous condition of the drum 66 based on the output of the home sensor 88.

Figure 6:
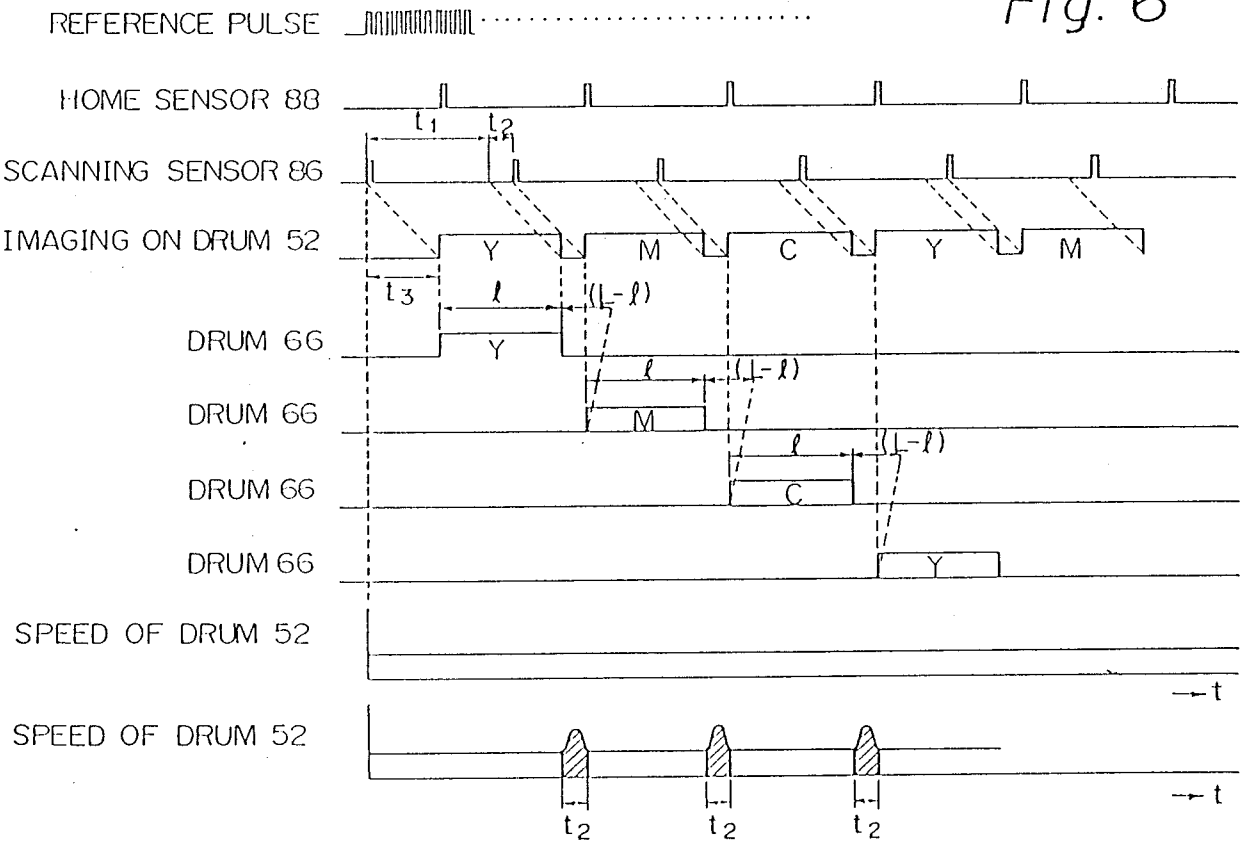
FIG. 6 is a timing chart associated with the flowcharts of FIGS. 5A and 5B.

When the toner images of colors M, C and Y provided by the developing device 62 are to be laid one upon another on the paper sheet 64*a* or 64*b*, it is important that the leading edge of the paper sheet on the transfer drum 66 be coincident in timing with the start of document scanning. It follows that the rotation speed of the drum 66 must be controlled to register the leading edge of the paper sheet with that of each toner image which is formed on the photoconductive drum 52. In this instance, the main control circuit 90 can see the size (length) l, the circumferential length L of the drum 66, the scanning time $t_1$ and the returning time $t_2$ of the optics 58, the angular distance R by which the drum 52 is rotated during the return of the optics 58, and the rotation speed $V_o$ of the drum 52, as shown in FIG. 6, even if a paper sensor used with the prior art system is absent. That is, so long as the main control circuit 90 controls the timings of a sequence of copying steps such as discharging, charging, exposing, developing, transferring, separating and fixing in response to the output of the home sensor and the reference pulses, it can see the timings to begin and end a speed control over the drum 66, and the scanning time and the returning time of the optics 58. Consequently, the drum 66 can be rotated by an angular distance of $(L-l)$ while the optics 58 is returned.

In the manner described, the start and stop of a transfer is controlled by the main control circuit 90. The time when a transfer is ended is delivered to the servo circuit 98 so that the rotation speed of the transfer drum 66 is controlled over the subsequent period of time $t_2$ to move the drum 66 by the distance of $(L-l)$.

Figures 5, 5A:
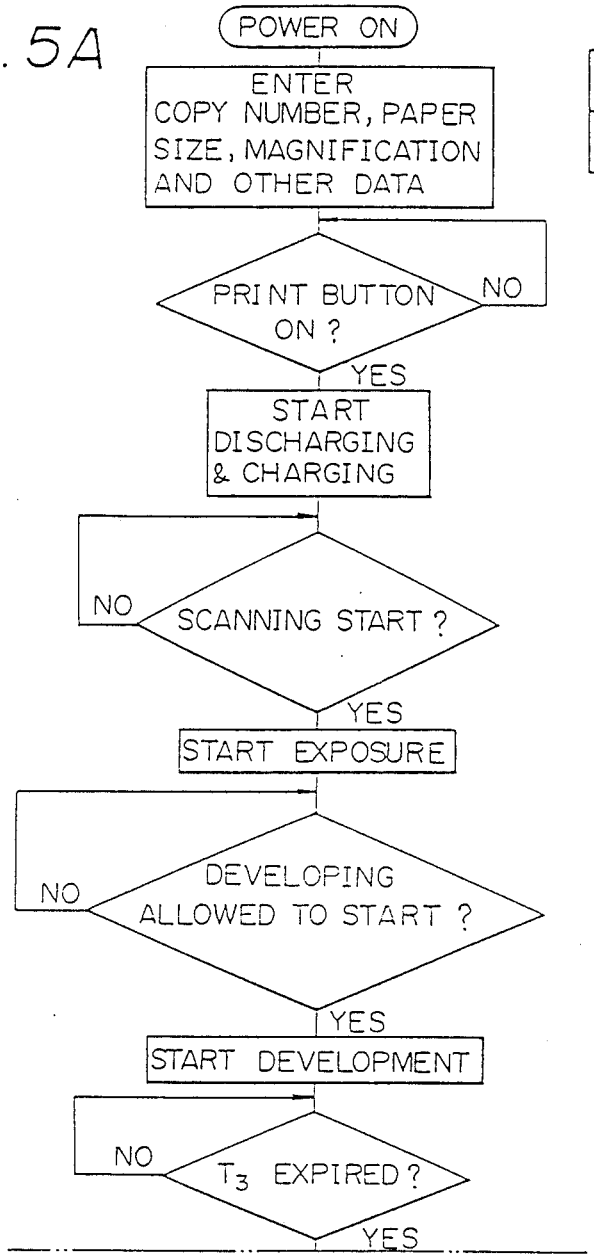
FIGS. 5A and 5B are flowcharts demonstrating the operation of the copier of FIG. 2.
Figure 5B:
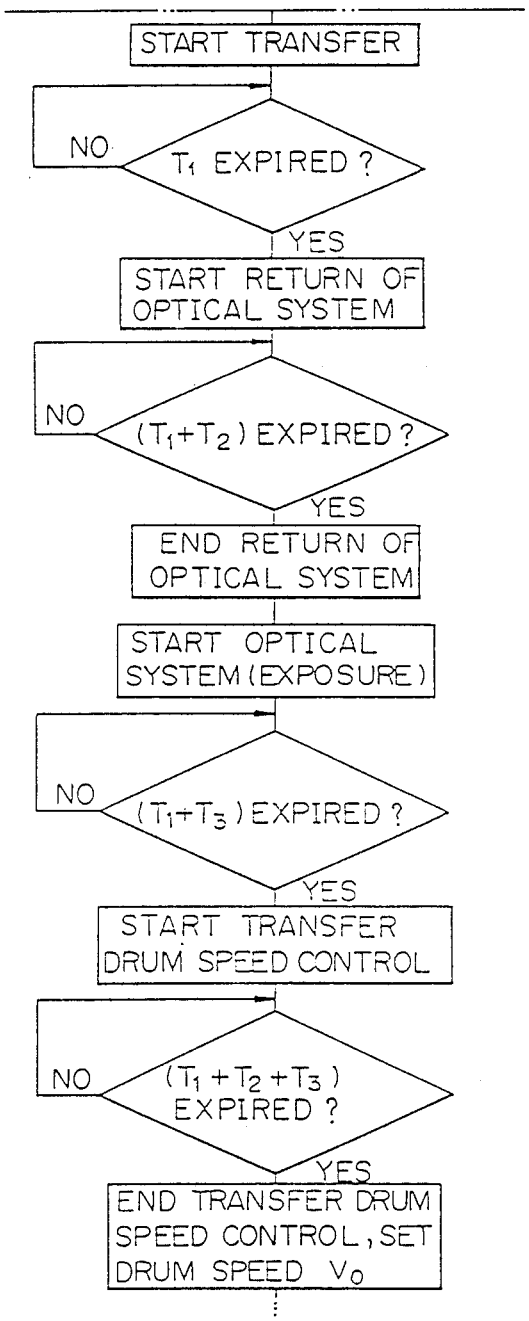

The operation and the operation control stated above will be explained with reference to FIGS. 5A, 5B and 6. FIGS. 5A and 5B are flowcharts demonstrating operation control which is performed in as color copy mode. FIG. 6 is a timing chart showing, in conformity of FIG. 5, a relationship between the timings of the images Y, M and C to be formed on the drum 52 and the operation timings of the drum 66, both of which are controlled on the basis of the reference pulses, the output of the home sensor 88 associated with the drum 66 and the output of the scanning sensor 88, as well as a relationship between the drums 52 and 66 in terms speed. In FIG. 6, L denotes the circumferential length of the drum 66, l the length of the paper sheet 64*a* or 64*b* set by the circuit 94, and R the returning length of the optics 58, as mentioned earlier.

In a color copy mode, various data such as the desired number of copies and the magnification are entered while, at the same time, the size (length) of the paper sheets 64*a* or 64*b* is entered through the paper size setting circuit 94. As a print button of the copier is depressed to start a copying operation, the photoconductive drum 52 is discharged and, then, charged. When a starting timing of optics 58 is reached, the optics 58 begins to scan a document (this timing is sensed by the scanning sensor 86) so that a latent image representative of a particular color component is electrostatically formed on the drum 52, which is rotating at a constant speed $V_o$. When a developing timing is reached, the latent image is developed by one of the developing units 62Y, 62M and 62C which contains toner complementary in color to the latent image. Upon the lapse of a period of time $t_3$ since the time when the optical system 58 has started the scanning, the transfer of the toner image from the drum 52 to the paper sheet 64*a* or 64*b* on the drum 66 begins. The period of time $t_3$ is adapted for an accurate transfer timing. At this instant, the drum 66 is rotated at the same speed, $V_o$, as the drum 52. At the end of the period of time $t_3$, the drum 66 has assumed its reference position as sensed by the home sensor 88 and the paper sheet 64*a* or 64*b* on the drum 66 has been registered at its leading edge with that of the toner image.

Meanwhile, upon the lapse of a period of time $t_1$ (corresponding to a length associated with the document size and the paper size) after the start of the scanning, the scanning is completed so that the servo motor 76 begins to be rotated in the opposite direction to return the optics 58. As a period of time $(t_1+t_2)$ expires after the start of the scanning, the return of the optics 58 is completed. Then, the servo motor 75 is driven forward to cause the optics 58 to start another scanning stroke immediately. This allows a latent image representative of the next color component to be formed on the drum 52 without awaiting the completion of one full rotation of the drum 52. the scanning of this time differs from that of the last time in that, whenthe time to complete the transfer is reached after a period of time $(t_1+t_3)$, the rotation speed of the drum 66 is variably controlled until the next transfer timing such that the drum 66 rotates at a higher speed than the drum 52. This, as considered on the drum 52, occurs within the returning time $t_2$ of the optics 58, and the paper is moved by the length of $(L-l)$ during that period of time. Upon the lapse of a period of time $(t_1+t_2+t_3)$, i.e., when the time to start a transfer is reached, the variable control over the speed of the drum 66 is terminated to drive the drum 66 at the same speed, Vo, as the drum 52.

The control procedure described above is repeated thereafter.

As shown in FIG. 6, among the various controls which are based on the reference pulses, the control of the transfer start timing and that of the transfer end timing are performed in response to the output of the home sensor 88 representative of an instantaneous position of the drum 66 and the output of the scanning sensor 86 representative of a scanning start timing. During the interval between the end of one transfer and the start of the next transfer, the rotation speed of the drum 66 is variably controlled to bring the leading edge of the paper sheet 64*a* or 64*b* into register with that of a toner image. So far as the relationship between the speed of the drum 52 and that of the drum 66 as shown in FIG. 6 is concerned, the variable control is such that the drum 66 is moved by the angular distance of $(L-l)$ within the returning time $t_2$ and by an integrated value as indicated by hatching in FIG. 6.

It is not necessary for the variable control over the transfer drum 66 discussed above to be applied to all the paper sizes for the following reasons. Although the circumferential length L of the transfer drum 66 is designed slightly greater than the length lm of the maximum paper size, the effect attainable with the variable control, i.e., the decrease in copying time becomes insignificant as the paper size becomes smaller and, rather, simply results in complicated control because $L>>L-lm$. In addition, A4 and B5 sizes which are examples of comparatively small paper sizes are not significantly different from each other so that there is not much point in controlling the transfer drum 66 for each of them. Hence, an arrangement may be made such that, by using a paper size which is one half the maximum paper size as a reference size, variable control applied to the reference size is also effected for all the sizes which are smaller than the reference size while no varible control is effected for the sizes which are larger than the same (i.e. the drum 66 is driven at a predetermined speed). The word "size" mentioned above should be understood to be a dimension measured in an intended direction of paper transfer, i.e. a direction in which a paper sheet is wrapped around the drum 66.

Figure 13:
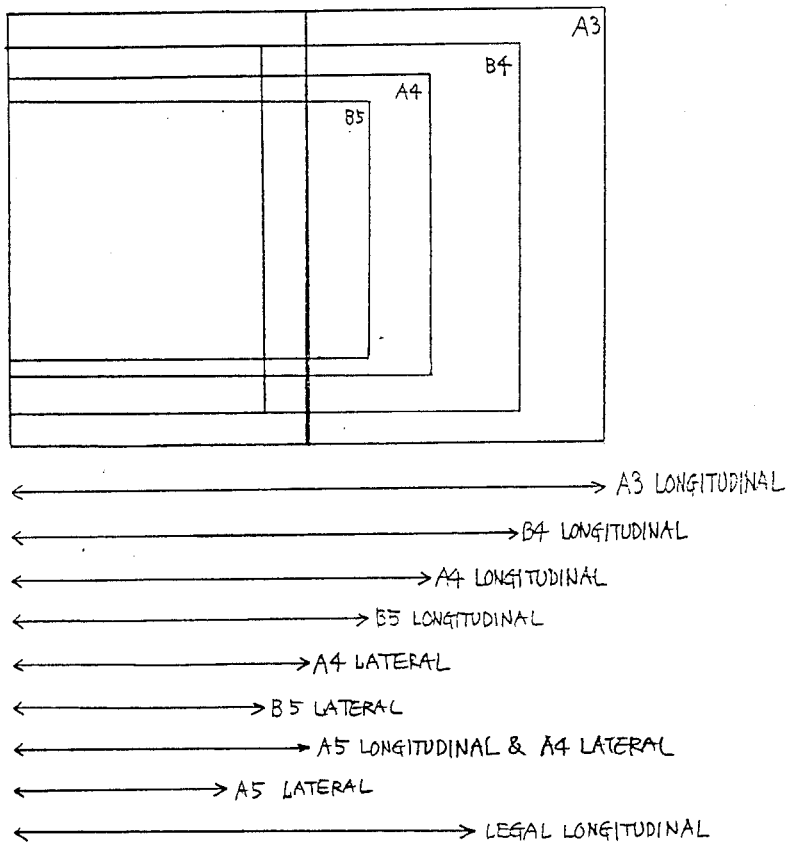
FIG. 13 shows a relationship between paper sheets of various sizes.

FIG. 13 is a developed view of paper sheets of various sizes which are wrapped around the transfer drum 66 and representative of a relationship in length between those paper sheets. Assuming that the maximum paper size is that of A3 paper sheets, the lateral dimension of size A4 is the reference size mentioned above. In this case, the variable control is applied to paper sheets the sizes of which correspond to the lateral dimension of size A4, the lateral dimension of size B4, the longitudinal dimension of size A5, and the lateral dimension of size A5. This is only illustrative, however. For example, assuming that the longitudinal dimension of legal size is selected to be the reference size, the constant speed control will be applied to paper sheets the sizes of which correspond to the longitudinal dimension of size A3 and the longitudinal dimension of size B4 while the variable control will be performed with paper sheets of the other sizes.

As described above, this embodiment of the present invention sets up an adequate color copying time for any particular paper size with a simple, inexpensive and reliable construction, thereby enhancing efficient copying operations. In addition, since the optics, photoconductive drum and transfer drum are driven and controlled as shown in FIGS. 5A, 5B and 6, the circumferential length of one of the two drums does not have to be an integral multiple of that of the other and may be a multiple other than integral multiples.

Second Embodiment

A second embodiment of the color copier in accordance with the present invention will be described in detail.

Figure 7:
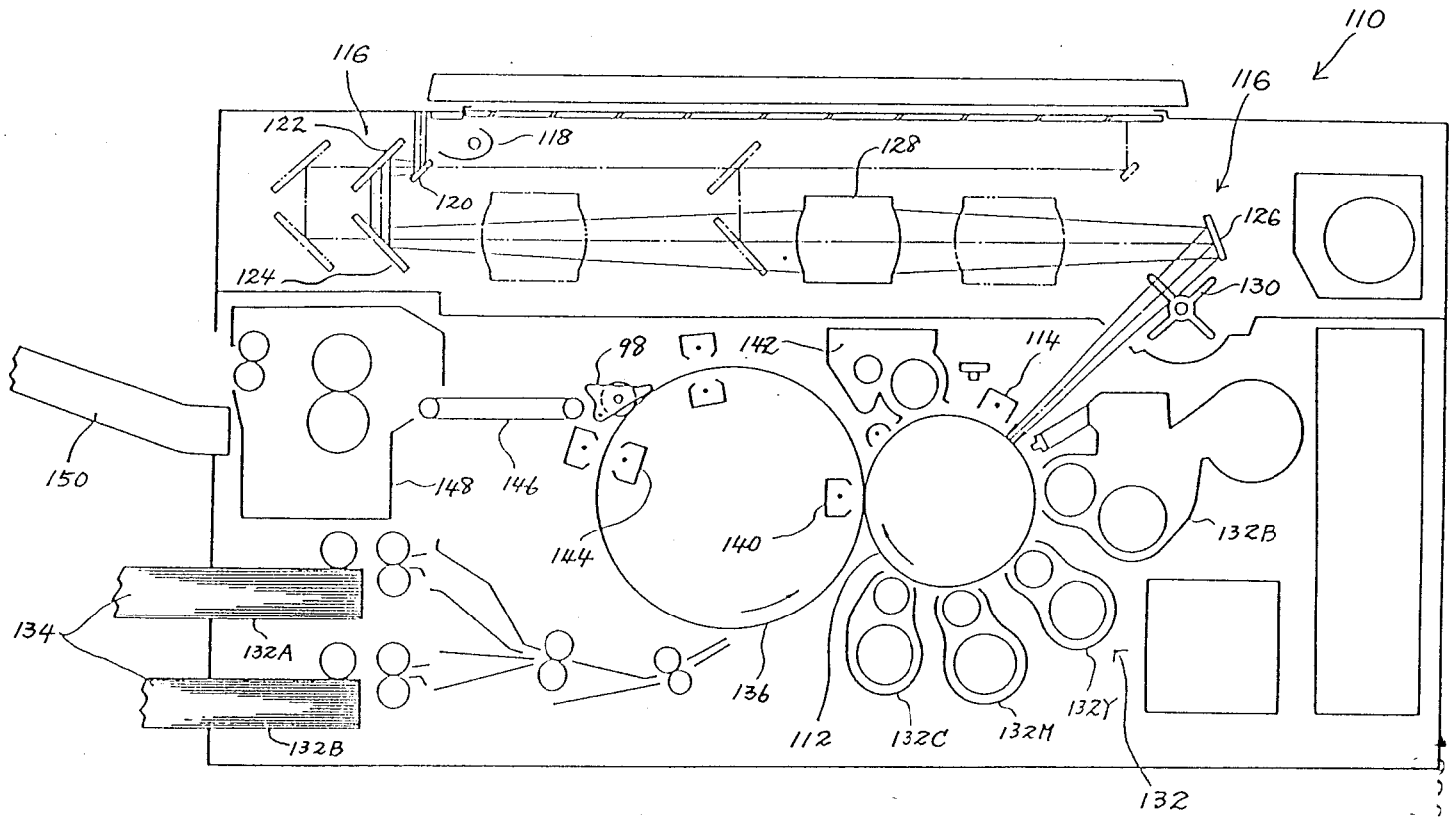
FIG. 7 is a sectional side elevation showing another embodiment of the present invention.

Referring to FIG. 7, the color copier, generally 110, includes a photoconductive drum 112 and a charger 114 which is located near the drum 112. Scanning optics 116 is disposed above the drum 112. The optics 116 is constructed as well known in the art and, as shown in FIG. 7, made up of a lamp, mirrors, a lens and others. The optics 116 repetitively performs a scanning stroke from a home position as indicated by solid lines to a position (a length corresponding to that a document or to a magnification) as indicated by phantom lines, and a return stroke from the latter to the former in the opposite direction. A color filter 130 adapted for the separation of colors is disposed in the optical path of the optics 116. A developing device 132 is located next to a position where an image is formed by the optics 116. As shown, the developing device 132 consists of a magenta developing unit 132M, a cyan developing unit 132C and yellow developing uint 132Y which are adapted for color copying, and a black developing unit 132B. Located next to the device 132 is a hollow transfer drum 136 which is rotatable with a paper sheet 134 loaded thereon. Specifically, any of paper sheets 134 which are different in size and fed from cassettes 138A and 183B is clamped by the drum 136 to undergo a plurality of consecutive times of transfer. A transfer charger 140 is disposed in the hollow drum 136. The reference numeral 142 designates a cleaning device.

Basically, the operation of the color copier 110 comprises the steps of: causing the optics 116 to repetitively scan a color original document to sequentially expose the photoconductive drum 112, which is rotated at a constant speed, to a plurality of different color components which are representative of the document, developing each of the resulting latent images on the drum 112 by supplying from the developing device 132 toner whose color is complementary to that of the color component, and sequentially transferring the toner images onto the paper sheet 134 which is held by the drum 136. the paper sheet 134 undergone the transfer is separated from the transfer drum 136 by a separator pawl 144 and, then, transported to a fixing device 148 by a belt 146. The paper sheet 134 coming out of the fixing device 148 is fed out to a tray 150.

In the color copier 110, the linear velocity of the drum 112 is changed depending upon the mode which is selected by an operating switch, not shown, i.e. a color mode or a black-and-white (or monocolor) mode. An experimental model was found operable with a linear speed of 2 in the black-and-white mode for a linear speed of 1 in the color mode, meaning that twice greater processing ability is attainable in the black-and-white copy mode. In this condition, the individual elements are controlled in speed in matching relation to the change in the linear speed of the drum 112.

Another capability achievable with the color copier 110 is combination copying, e.g., it is capable of copying in combination a color image and a monocolor image of a plurality of documents on the same paper sheet. Specifically, in a combination copy mode, a color image of a first document is produced first. At this instant, the paper sheet 134 is constantly retained on the transfer drum 136 and, after the transfer of the color image, held in a halt. The position of the paper sheet 134 which is in a halt is stored in a central processing unit (CPU) of the copier 110, so that in the event of the transfer of a monocolor image the leading edge of the image and the paper sheet are synchronized to each other for producing a combined copy. No doubt, such a combination of images is only illustrative and may be replaced with any other desired one. Further, positions of images to be combined on the same paper sheet may be specified by entering position data on an operation board and driving the transfer drum 136 in a particular range specified.

Figure 8:
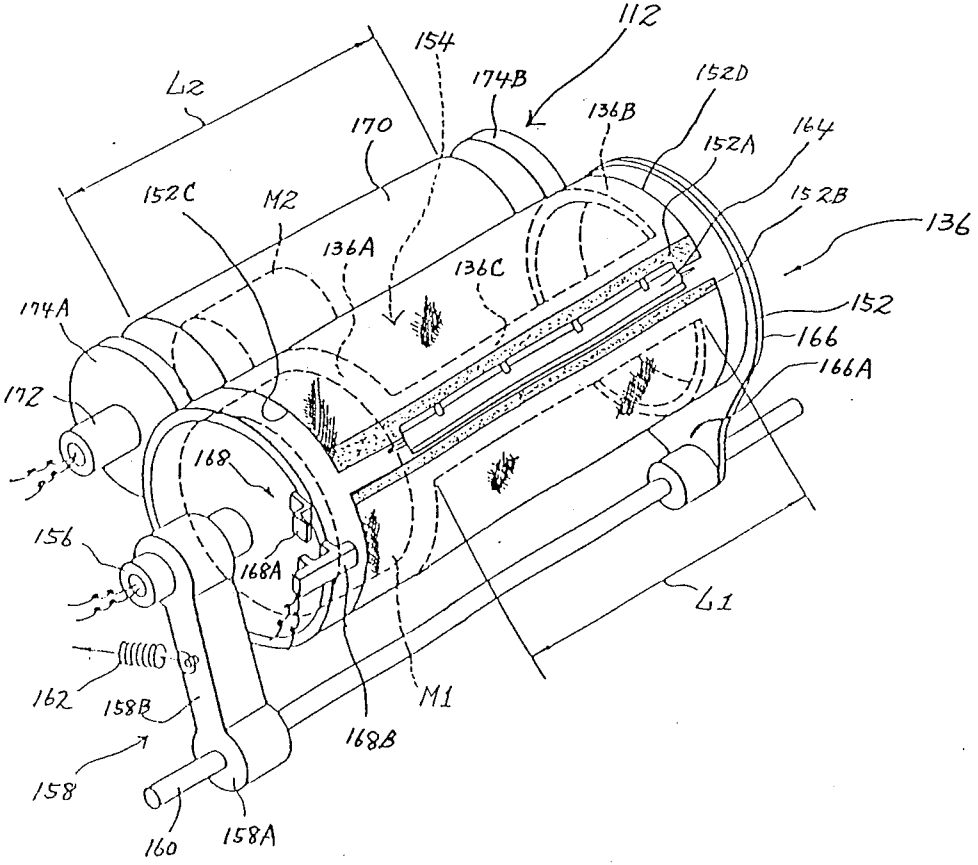
FIG. 8 is a perspective view showing a photoconductive drum and a transfer drum which are included in the copier of FIG. 7.
Figure 9:
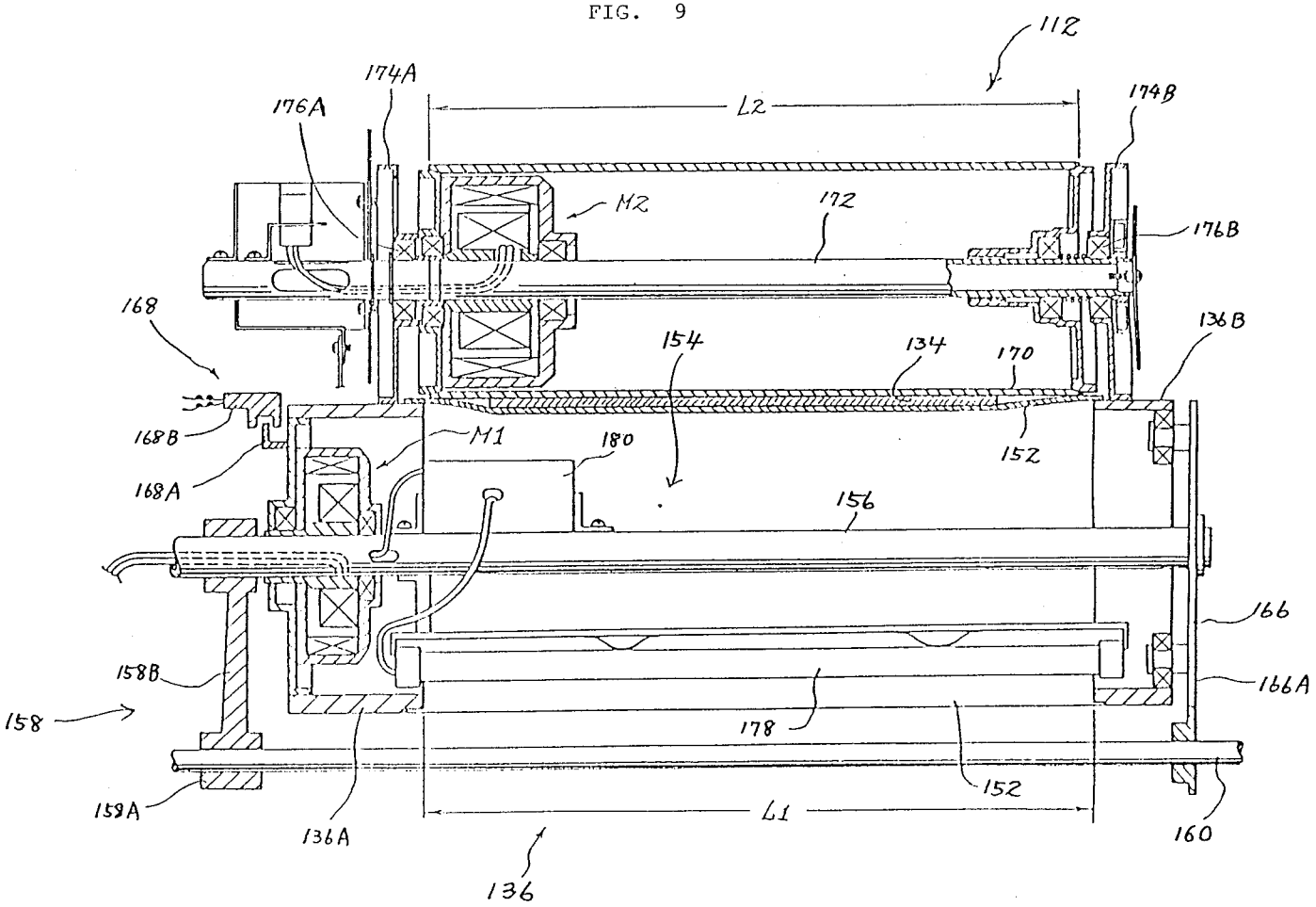
FIG. 9 is a sectional side elevation showing the photoconductive and transfer drums of FIG. 8.

Referring to FIGS. 8 and 9, there are shown the transfer drum 136 and the photoconductive drum 112 which are exemplary transfer means and exemplary photoconductive means, respectively. The transfer drum 136 which has a hollow cylindrical configuration is constituted by two rings 136A and 136B which are located coaxially with and at spaced locations from each other, and a connecting portion 136C which extends parallel to the axis of the drum 136 to interconnect the rings 136A and 136B. A dielectric sheet 152 is implemented with a flexible member and wrapped around the transfer drum 136 by using the circumferential surfaces of the rings 136A and 136B. Opposite ends 152A and 152B of the dielectric sheet 152 are individually fixed to the connecting portion 136C by adhesive, hooks or like suitable fixing means. Opposite sides edges 152C and 152D of the dielectric sheet 152 are not fixed to the rings 136A and 136B. The transfer drum 136 is void of a wall between the rings 136A and 136B, defining an intermediate opening 154 there. The dimension of the intermediate opening 154 as measured in the axial direction of the transfer drum 136 is assumed to be $L_1$. The transfer drum 136 is supported by a hollow shaft 156. An outer rotor type motor $M_1$ is disposed in the transfer drum 136 to drive the outer peripheral portion of the drum 136 in a rotray motion relative to the shaft 156. One end of the shaft 156 is rotatably connected to one end of an arm 158 the other end of which is in turn rotatably connected to a stationary shaft 160. A tension spring 12 is anchored to an intermediate portion 158B of the arm 158 so that a predetermined transfer pressure is applied from the transfer drum 136 to the photoconductive drum 152. A sheet gripper 164 for gripping the leading edge of a paper sheet is provided on the connecting portion 136C of the transfer drum 136. The other end of the shaft 156 is fixedly connected to a face plate 166 while the outer peripheral portion of the transfer drum 136 is journalled to the face plate 166 (see FIG. 9). A base portion 166A of the face plate 166 is rotatably connected to the stationary shaft 160. A member 168A to be senses is fixed to one end portion of the transfer drum 136 while a sensor 168B is fixed to an unmovable member, not shown, and located in a path along which the member 168A is movable. Constituted by a light emitting element and a light-sensitive element, for example, the sensor 168B cooperates with the member 168A to constitute a home position sensor for sensing a home position of the transfer drum 136.

The photoconductive drum 112 which is a rigid member includes a photoconductive material 170 which is wrapped around the drum 112. The drum 112 itself is rotatably mounted on a hollow stationary shaft 172. An outer rotor type motor $M_2$ is disposed in the drum 112 to drive the latter at a constant speed in a rotary motion. Labeled $L_2$ is the width of the photoconductive drum 112, strictly the width of the photoconductive material 170. In this embodiment, the width $L_2$ of the drum 112 is smaller than that $L_1$ of the intermediate opening 154 of the transfer drum 136.

Positioning disks 174A and 174B each in the form of a rotatable ring are positioned at axially opposite end portions of the photoconductive drum 112 and rotatable relative to the shaft 172 through bearings 176A and 176B, respectively, FIG. 9. The positioning disks 174A and 174B are pressed against, respectively, those portions of the rings 136A and 136B of the transfer drum 136 in which the dielectric sheet 152 is absent, whereby the drums 112 and 136 are spaced apart from each other by a predetermined distance which allows the dielectric sheet 152 and the photoconductive material 170 to make light contact with each other.

In the above construction, the transfer pressure is developed between the transfer drum 136 and the photoconductive drum 112 by way of the positioning disks 174A and 174B which are free to rotate relative to the shaft 172. This, coupled with the fact that the width $L_2$ of the photoconductive material 170 is smaller than $L_1$ of the intermediate opening 154 of the drum 136, causes the material 170 and the dielectric sheet 152 to slip smoothly on each other even when the rotation speed of the drum 136 is changed relative to that of the drum 112. Hence, the image reproduction is free from blurring, jitter and other undesirable occurrences. Since the positioning disks 174A and 174B are pressed against the transfer drum 136 avoiding the dielectric sheet 152, the sheet 152 is prevented from being deformed or rolled even after a long time of use, insuring reliability of operation as well as durability. Furthermore, the accuracy required of the framework of the transfer drum 136 and, therefore, the cost is cut down, compared to the prior art design.

In this particular embodiment, the paper sheet 134 is positioned between the photoconductive material 170 and the dielectric sheet 152 which yields into the intermediate opening 154. This promotes uniform transfer of a toner image and, yet, increases the transfer efficiency. Implemented with a flexible film of polyester, 4-vinylidene fluoride or like material, the dielectric sheet 152 is capable of uniformly urging even relatively thin paper sheets due to elasticity for thereby insuring image transfer. Since the photoconductive drum 112 is not directly pressed by the transfer drum 136 and since the dielectric sheet 152 is not directly pressed by the disks 174A and 174B, thee is eliminated the deposition of toner, paper dust and other particles which would otherwise damage the materials 170 and 152 and/or affect the image transfer. In FIG. 9, the reference numeral 178 designates a separating charger which is powered by a power pack 180 that is documented on the shaft 156. The hollow shafts 156 and 172 are individually used to accommodate the leads adapted for the drive of the motors $M_1$ and $M_2$ therein.

Figure 10:
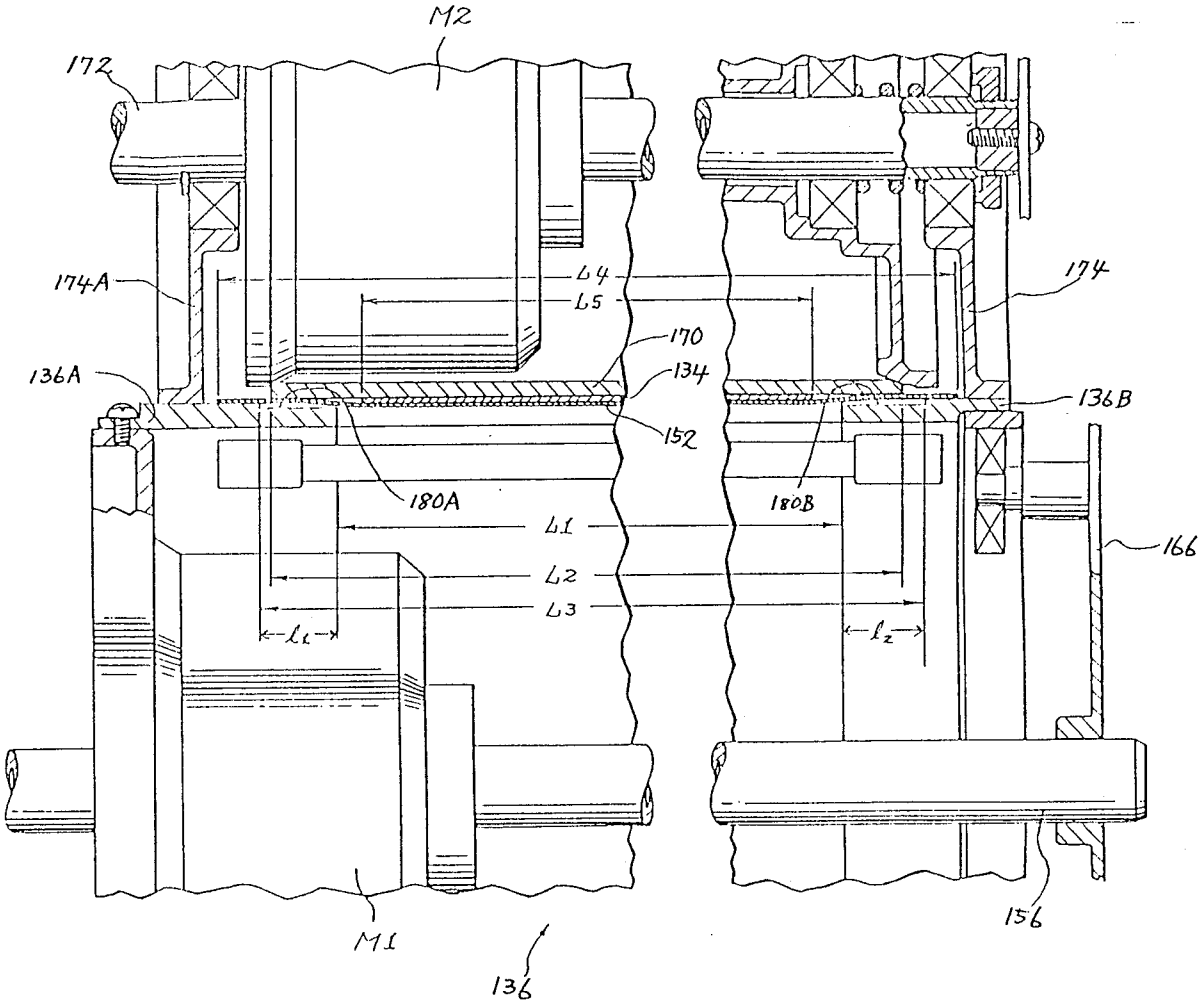
FIG. 10 is a sectional side elevation showing a modification to the drums of FIG. 9.

Referring to FIG. 10, a modification to the above embodiment is shown in a fragmentary enlarged view. As shown, the rings 136A and 136B of the transfer drum 136 are provided with, respectively, stepped portions 180A and 180B each allowing the dielectric sheet 152 to yield thereinto. The sum of the widthwise dimension $L_1$ of the intermediate opening 154 and dimensions $l_1$ and $l_2$ of the stepped portions 180A and 180B, respectively, is assumed to be $L_3$. In this case, the total dimension including those of the stepped portions 180A an 180B is the width of the transfer means and substantially constitutes a region into which the dielectric sheet 152 can yield. Hence, the width $L_2$ of the photoconductive drum 112 does not have to be smaller than that $L_1$ of the intermediate opening 154, i.e., the width $L_2$ need only be smaller than the dimension $L_3$ which includes the stepped portions 180A and 180B. In this modification, the width $L_4$ of the dielectric sheet 152 is smaller than the distance between the positioning disks 174A and 174B and, therefore, the disks 174A and 174B are not pressed against the dielectric sheet 152. The dimension of the paper sheet 134 is indicated by $L_5$ and smaller than the dimension $L_1$ of the intermediate opening 154.

Figure 11:
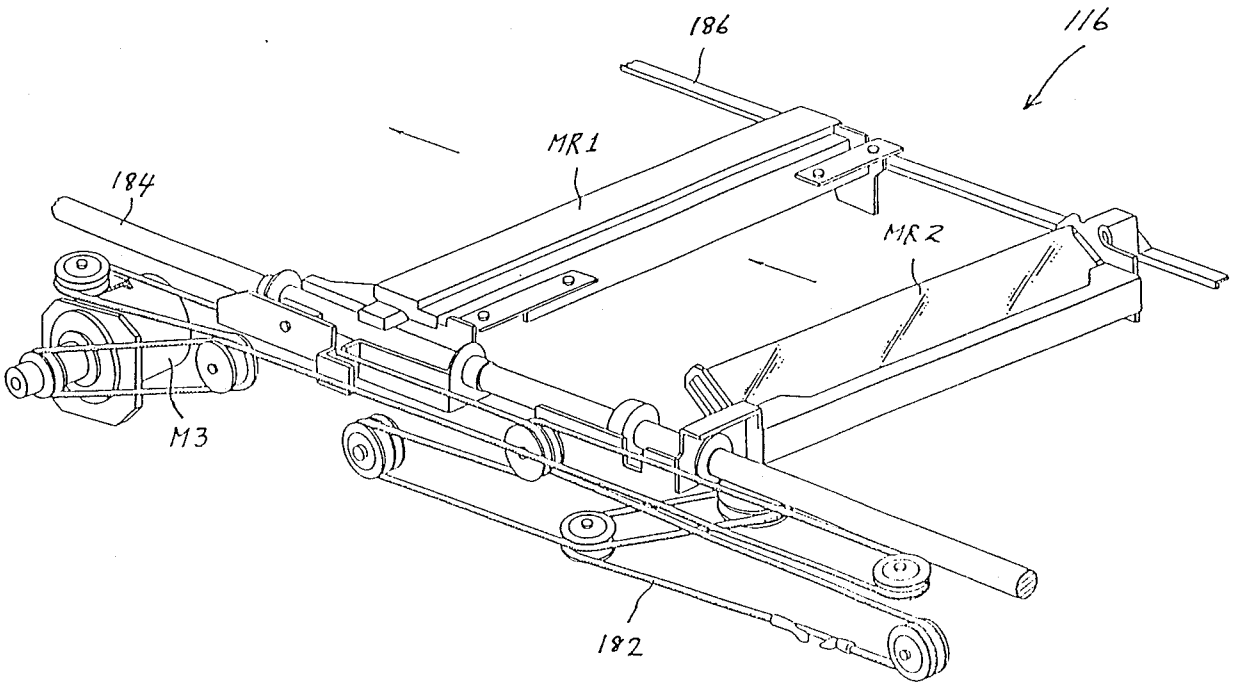
FIG. 11 is a pespective view showing optics which are included in the copier of FIG. 7.

As shown in FIG. 11, the optics 116 of this embodiment includes an exclusive reversible motor M3 and a single wire 182 which is connected to a first mirror $MR_1$ and a second mirror $MR_2$ by way of a pulley of the motor $M_3$. The motor $M_3$ may be implemented with a servo motor with an encoder built therein (resolution of about 20 μm/pulse). The first and second mirrors $MR_1$ and $MR_2$ are movable as indicated by arrows guided by guides 184 and 186. Due to the wire 182 which uses the principle of movable pulley, the moving speeds of the mirrors $MR_1$ and $MR_2$ are expressed as, respectively, $V_o/m$ and $\frac{1}{2}\times V_o/m$ where $V_o$ denotes a speed under a 1 magnification, and m denotes a copy magnification.

Figure 12:
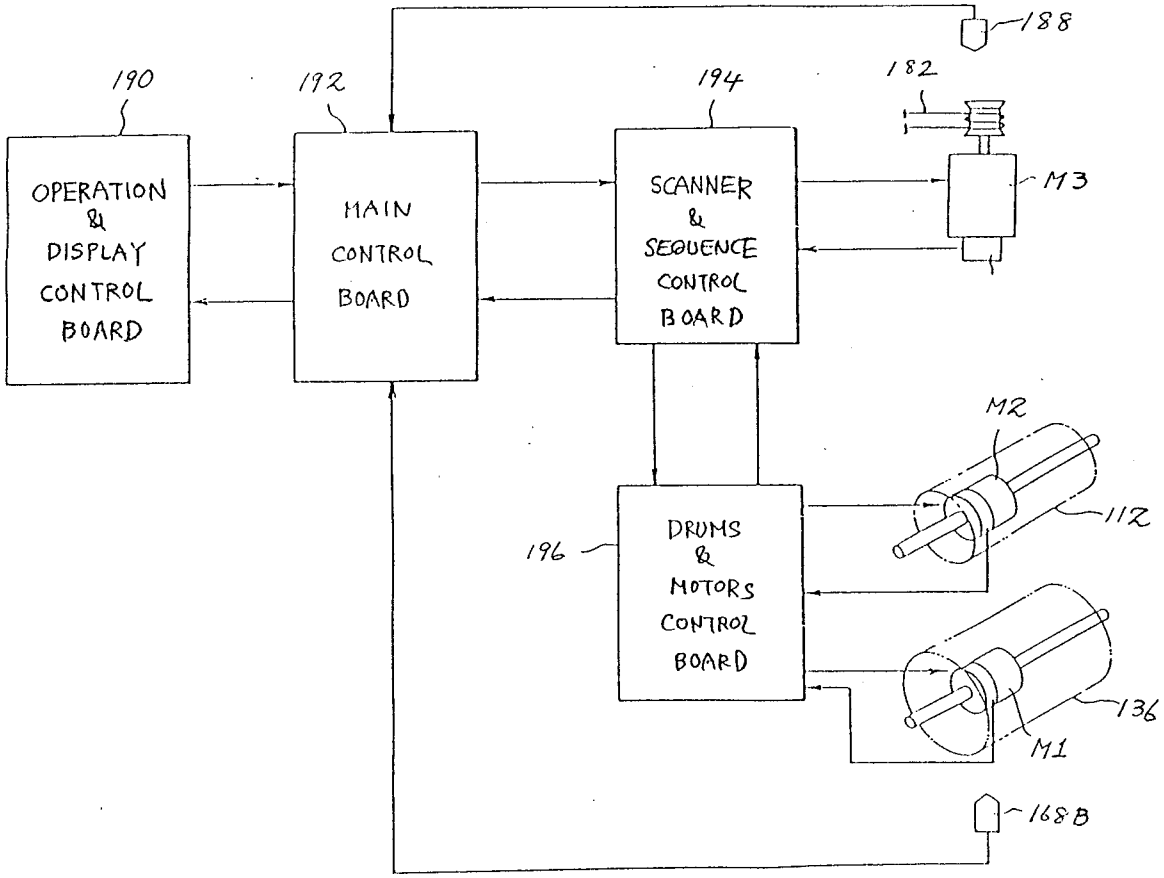
FIG. 12 is a view schematically showing a control section built in the copier of FIG. 7.

The scan start position or home position of the optics 116 is sensed by a scanning sensor 188, FIG. 12, which is mounted on a part of the wire 182.

As in the first embodiment, the photoconductive drum 112, transfer drum 136 and optics 116 of the color copier 110 are driven by the exclusive motors $M_1$, $M_2$ and $M_3$, respectively, and independently of each other. Since the drums 112 and 136 are regulated by the positioning disks 174A and 174B which are free to rotate, they can be controllably driven independently of each other and, therefore, do not have to be interconnected by gears which would entail vibrations and, thereby, degrade the quality of image reproduction. The color copier 110 is free from the limitation that one of the two drums should be greater in circumferenial direction than the other by an integral multiple, achieving a remarkable improvement in copying speed. These advantages are attainable even if the drums are replaced with endless belts. In an experimentary model implemented with this embodiment, the diameters of the photoconductive drum 112 and transfer drum 136 were 120 millimeters and 180 millimeters, respectively.

The drums 112 and 136 and optics 116 of the second embodiment may be driven and controlled in exactly the same manner as in the first embodiment, i.e., by the drive and control systems shown in FIGS. 3 an 4 and as shown in FIGS. 5 and 6.

Specifically, in the second embodiment, too, there are provided a reference pulse generator (corresponding to the reference pulse generator 92 of FIG. 3) for driving the motor M2 associated with the photoconductive drum 112 at a predetermined speed, servo circuits (corresponding to the servo circuits 96 and 98 of FIG. 3) for individually controlling the speed of the motor $M_1$ associated with the transfer drum 136 and the motor $M_3$ associated with the optics 116, and a circuit (corresponding to the circuit 94 of FIG. 3) for delivering a paper size indication to the servo circuits. In such a construction, the transfer start timing and the transfer end timing are detected on the basis of an output signal of a scanning sensor 188 installed in the optics 116 and that of the home sensor 168 associated with the transfer drum 136. The rotation speed of the drum 136 is controlled during interval between the transfer end timing and the transfer start timing detected, so that the leading edge of the paper sheet 134 on the drum 136 and that of any of the toner images on the photoconductive drum 112 may coincide with each other. That is, it is not that the scanning, or exposure, begins at the same position for all the images of different colors awaiting the end of one full rotation of the drum 112 each time, but that immediately after a return stroke of the optics 116 the next scanning begins to expose the drum 112 imagewise. As a result, the scannning stroke is reduced with the paper size. In this instance, the rotation speed of the transfer drum 136 is controlled independently of that of the photoconductive drum 112 in order to eliminate misalignment during image transfer.

It is to be noted that the home sensor 168 may be replaced with the paper sensor 32 which is included in the prior art arrangement of FIG. 1.

Referring to FIG. 12, there is schematically shown a control section of this embodiment. As shown, the control section includes an operation and display board 190 which is provided with keys for entering various kinds of commands as well as a data display panel. A main control board 192 is provided for totally controlling the color copier 110. A board 194 is adapted for the control over the optics 116 and the sequence control while a board 196 is adapted for the control over the motors $M_1$ and $M_2$ which are associated with, respectively, the transfer drum 136 and photoconductive drum 112. The output of the motor $M_3$ is coupled to the board 194. The outputs of the motors $M_1$ and $M_2$ are fed to the board 196. Likewise, the output of the sensor 168B is applied to the board 192.

The boards 194 and 194 interchange a drum 136 position command signal, a drum 136 speed command signal, a drum 112 speed command signal, a CPU clock pulse signal, and others. The boards 192 and 194 interchange and ouput of the scanning sensor 188 of the optics 116, a drum 136 reference position signal, an optics 116 scan start signal, a drum 112 speed command signal, a drum 136 reference signal, and others. Further, the boards 192 and 190 interchange a paper 134 size signal, a magnification command signal, a copy mode (multicolor or monocolor) signal, a copy number command signal, and others. Such a control system controls the drums 136 and 112 and optics 116 relative to each other on a rear time basis, i.e., it synchronizes them with considerable accuracy.

As described above, the second embodiment of the present invention promotes miniaturization of a color copier and improves the quality of image reproduction because it is needless for the circumferential length of one of photoconductive and transfer drums to be an integral multiple of that of the other.

Various modifications will become possible for those skilled in the art after receiving the teachings of the present disclosure without departing from the scope thereof. For example, the photoconductive drum and the transfer drum in any of the first and second embodiments shown and described may be replaced with a photoconductive belt and a transfer belt, respectively.

What is claimed is:

1. A control system for a color copier having optics for scanning, photoconductive means, and transfer means, comprising:

paper size setting means for setting a size of a paper sheet to be used before a copying operation;

scanning sensor means for sensing a start of a scanning performed by said optics;

home sensor means for sensing an instantaneous angular position of said transfer means; and control means for determining a transfer start time and a transfer end time in response to a paper size signal outputted by said paper size setting means, an output signal of said scanning sensor means, and an output of said home sensor means, and variably controlling a rotation speed of said transfer means during an interval between said transfer start and transfer end times so as to register a leading edge of a paper sheet loaded on said transfer means and a leading edge of each of toner images formed on said photoconductive means and different in color from each other.

2. A control system as claimed in claim 1, further comprising drive means for driving said optics, said photoconductive means and said transfer means independently of each other.

3. A control system as claimed in claim 2, wherein each of said drive means comprises a servo motor.

4. A control system as claimed in claim 3, further comprising servo circuits for controlling the drive of said motors independently of each other.

5. A control system as claimed in claim 4, further comprising pulse generating means for generating reference pulses.

6. A control system as claimed in claim 1, wherein said photoconductive means and said transfer means comprise a photoconductive drum and a transfer drum, respectively.

7. A control system as claimed in claim 1, wherein said photoconductive means and said transfer means comprise a photoconductive belt and a transfer belt, respectively.

8. A control system for a color copier having optics for scanning, photoconductive means, and transfer means, comprising:

paper size setting means for setting a size of a paper sheet to be used before a start of a copying operation to produce a paper size set signal;

scanning sensor means for sensing a start of a scanning performed by said optics to produce a scanning start signal;

home sensor means for sensing a home position of said transfer means to produce a home position signal;

drive means for driving said optics, said photoconductive means and said transfer means independently of each other;

control means for realizing different timing programs which are selectable, the respective timing program for timing the complete copying operation sequence being changeable in dependence upon said paper size set signal of said paper size setting means, said scanning start signal of said scanning sensor means, and said home position signal of said home sensor means; and servo means for adjusting predetermined operation parameters of said color copier so as to selectively adjust said respective drive means in response to said respective timing program.

9. A control system as claimed in claim 8, wherein said photoconductive means and said transfer means comprise a photoconductive drum and a transfer drum, respectively.

10. A control system as claimed in claim 8, wherein said photoconductive means and said transfer means comprise a photoconductive belt and a transfer belt, respectively.

11. A control system as claimed in claim 8, wherein each of said drive means comprises an own servo motor.

12. A control system as claimed in claim 11, wherein said servo means comprises servo circuit for independently controlling said servo motors.

13. A control system as claimed in claim 12, further comprising pulse generating means for generating reference pulses.

14. An image forming apparatus comprising, in combination:

movable photoconductive means and transfer means one of which is greater in circumferential length than the other by a multiple other than integral multiples; and drive control means for independently controlling said photoconductive means and said transfer means including a home sensor means for generating a home position signal upon sensing a home position of said transfer means.

15. An image forming apparatus as claimed in claim 14, further comprising scanning optics which is driven by said drive control means independently of said photoconductive means and said transfer means.

16. An image forming apparatus as claimed in claim 15, wherein said drive control means comprises:

scanning sensor means for producing a scanning start signal upon sensing a start of a scanning performed by said optics;

photoconductive means driving means for driving said photoconductive means at a predetermined speed;

transfer means driving means for driving said transfer means; and control means responsive to said scanning start signal and said home position signal for controlling said transfer means driving means to vary the speed of said transfer means.

17. An image forming apparatus as claimed in claim 16, wherein said drive control means further comprises paper size setting means for setting a paper size of a paper sheet to be used before a copying operation to produce a paper size signal, said drive control means being constructed to detect a transfer start and a transfer end time in response to said paper size signal, said scanning start signal, and said home position signal and, during an interval between said transfer start and transfer end times, variably control the speed of said transfer means to bring a leading edge of a paper sheet loaded on said transfer means and a leading edge of a toner image formed on said photoconductive means into register with each other.

18. An image forming apparatus as claimed in claim 16, wherein said photoconductive means driving means and said transfer means driving means each comprises a servo motor.

19. An image forming apparatus as claimed in claim 18, further comprising servo means for controllably driving said servo motors.

20. An image forming apparatus as claimed in claim 19, further comprising pulse generating means for generating reference pulses.

21. An image forming apparatus as claimed in claim 14, wherein said photoconductive means and said transfer means comprise a photoconductive drum and a transfer drum, respectively.

22. An image forming apparatus as claimed in claim 14, wherein said photoconductive means and said transfer means comprise a photoconductive belt and a transfer belt, respectively.

* * * * *

UNITED STATES PATENT AND TRADEMARK OFFICE

CERTIFICATE OF CORRECTION

PATENT NO. : 4,872,037

DATED : Oct. 3, 1989

INVENTOR(S) : Nobuo Kasahara, et al

It is certified that error appears in the above-identified patent and that said Letters Patent is hereby corrected as shown below:

One of the Foreign Application Priority Data has been omitted,
"Mar. 2, 1987 [JP] Japan.....62-46995", should be:

--Mar. 2, 1987 [JP] Japan.....62-46995
Feb. 13, 1986 [JP] Japan.....61-29618--

Signed and Sealed this

Twenty-fifth Day of September, 1990

*Attest:*

HARRY F. MANBECK, JR.

*Attesting Officer*

*Commissioner of Patents and Trademarks*